United States Patent [19]

Kissen et al.

[11] 4,095,289

[45] Jun. 20, 1978

[54] AIR VENTILATION APPARATUS FOR FLIGHT HELMET

[75] Inventors: Abbott T. Kissen, Centerville; Willi J. Buehring, Montgomery County; Warren G. Miller, Greene County; Milton Alexander, Montgomery County; James S. Ater, Montgomery County; Donald H. Lowe, Montgomery County, all of Ohio

[73] Assignee: The United States of America as represented by the Secretary of the Air Force, Washington, D.C.

[21] Appl. No.: 719,315

[22] Filed: Aug. 31, 1976

[51] Int. Cl.[2] ..... A42B 3/00; A42C 5/04

[52] U.S. Cl. ..... 2/6; 128/142 R; 2/171.3

[58] Field of Search ..... 2/6, 171.3, 5, 7, 10; 128/141 R, 142 R, 142.3

[56] References Cited

U.S. PATENT DOCUMENTS

| | | | |
|---|---|---|---|
| 2,813,271 | 11/1957 | Finken | 2/6 |
| 3,223,086 | 12/1965 | Denton | 2/6 X |
| 3,748,657 | 7/1973 | Aileo | 2/6 |
| 3,833,935 | 9/1974 | Ansite et al. | 2/6 |
| 3,963,021 | 6/1976 | Bancroft | 2/171.3 X |

*Primary Examiner*—Werner H. Schroeder
*Assistant Examiner*—Peter Nerbun
*Attorney, Agent, or Firm*—Joseph E. Rusz; Richard J. Killoren

[57] ABSTRACT

An air ventilation apparatus for a flight helmet having a member secured to the helmet and having portion spaced from the helmet to form a plenum chamber and exit nozzle. The exit nozzle is positioned to provide an air flow between the face of the user and the helmet visor. An air inlet is provided on the member, secured to the helmet, for supplying air to the plenum chamber. Spacers are provided between the helmet face mask assembly and the helmet to fit the visor assembly to the helmet when the plenum chamber is attached to the helmet.

1 Claim, 5 Drawing Figures

AIR VENTILATION APPARATUS FOR FLIGHT HELMET

RIGHTS OF THE GOVERNMENT

The invention described herein may be manufactured and used by or for the Government of the United States for all governmental purposes without the payment of any royalty.

BACKGROUND OF THE INVENTION

The use of an air stream over the face for ventilation and cooling purposes has been used in various types of helmets and face masks. The patents to Hobson, U.S. Pat. No. 3,584,314; Schoelz et al, U.S. Pat. No. 3,649,964; Ciolone, U.S. Pat. No. 3,657,740; Rosendahl et al, U.S. Pat. No. 3,881,478; and Bancroff, U.S. Pat. No. 3,963,021 shows the use of air flow for these purposes. To provide such an air flow for a flight helmet with a visor assembly, however, presents certain problems. Flight personnel must operate under various flight conditions so that it is necessary that the flight personnel be able to provide ventilating air which will either cool or warm the wearer's face. Also, the ventilation system must be adapted for use with the flight helmet and must not be too cumbersome.

BRIEF SUMMARY OF THE INVENTION

According to this invention, an air plenum apparatus is provided which substantially conforms to the surface of a conventional flight helmet and which fits between the helmet and the standard visor assembly in a manner that does not alter the normal operation and function of the visor assembly. The air supply system for the plenum can be provided with controls which permit the wearer to control the temperature of the ventilating air.

IN THE DRAWINGS

DETAILED DESCRIPTION OF THE INVENTION

Figure 1:
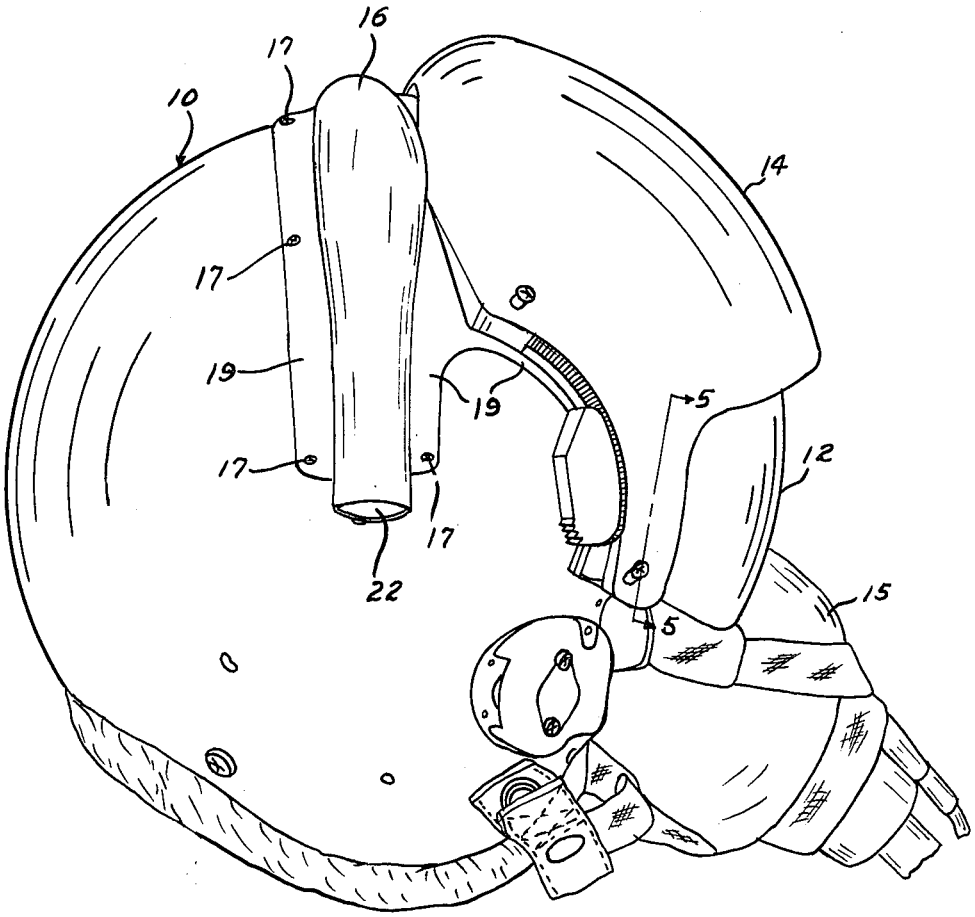
FIG. 1 is a side view of a conventional flight helmet, modified according to the invention.
Figure 2:
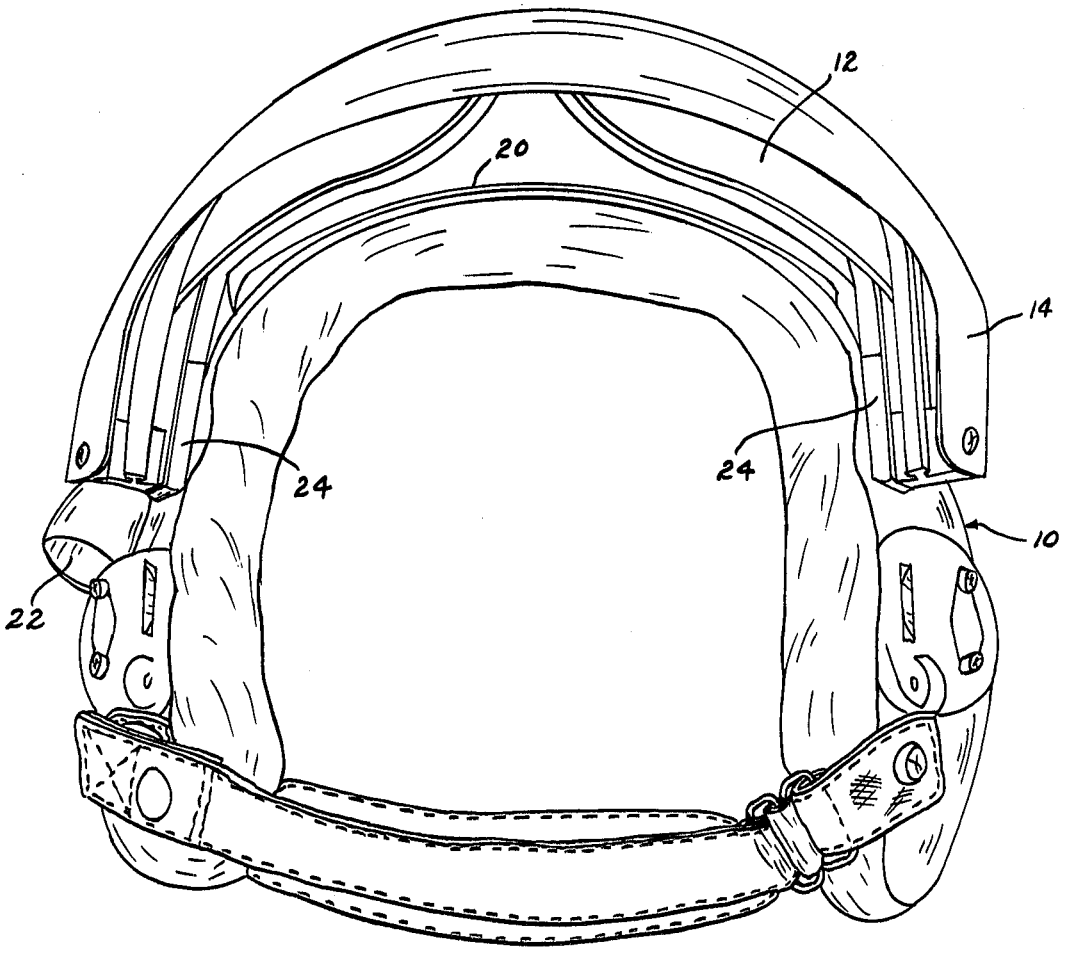
FIG. 2 is a front view of the helmet of FIG. 1 with the visor raised and the face mask removed.
Figure 3:
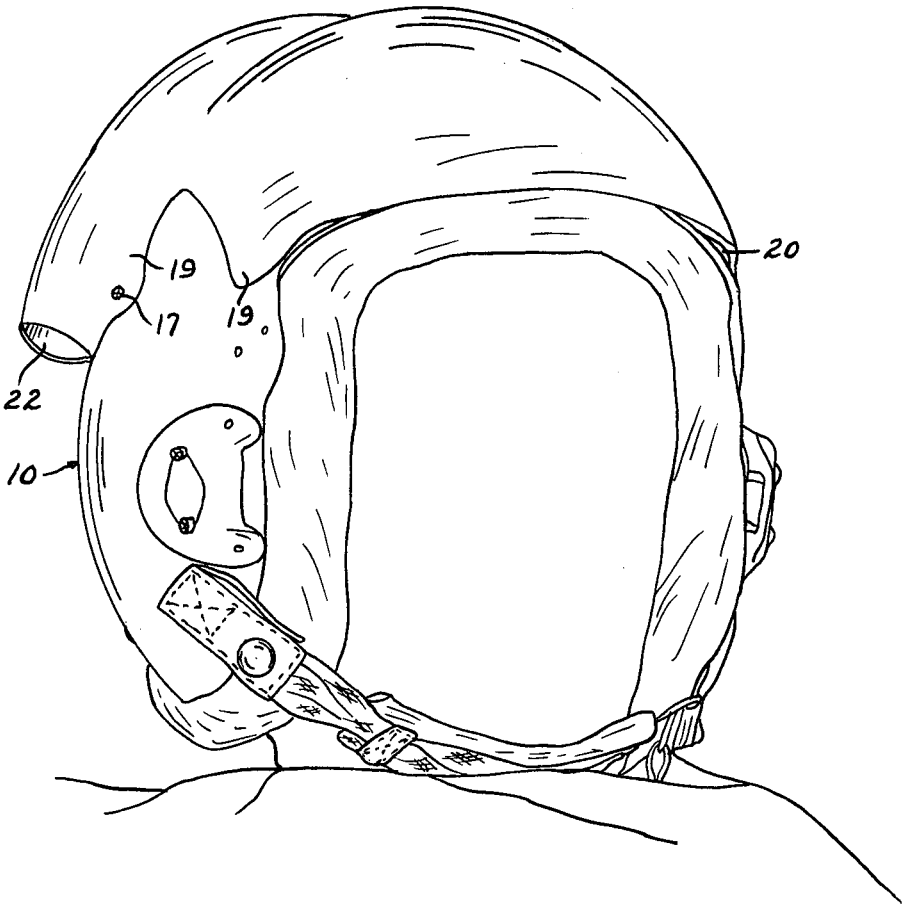
FIG. 3 is an isometric view of the helmet of FIG. 2 with the visor assembly removed.
Figure 5:
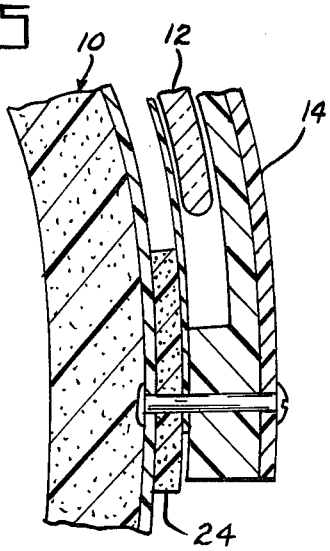
FIG. 5 is a partially cut away enlarged sectional view of the device of FIG. 1 along the line 5—5.
Figure 4:
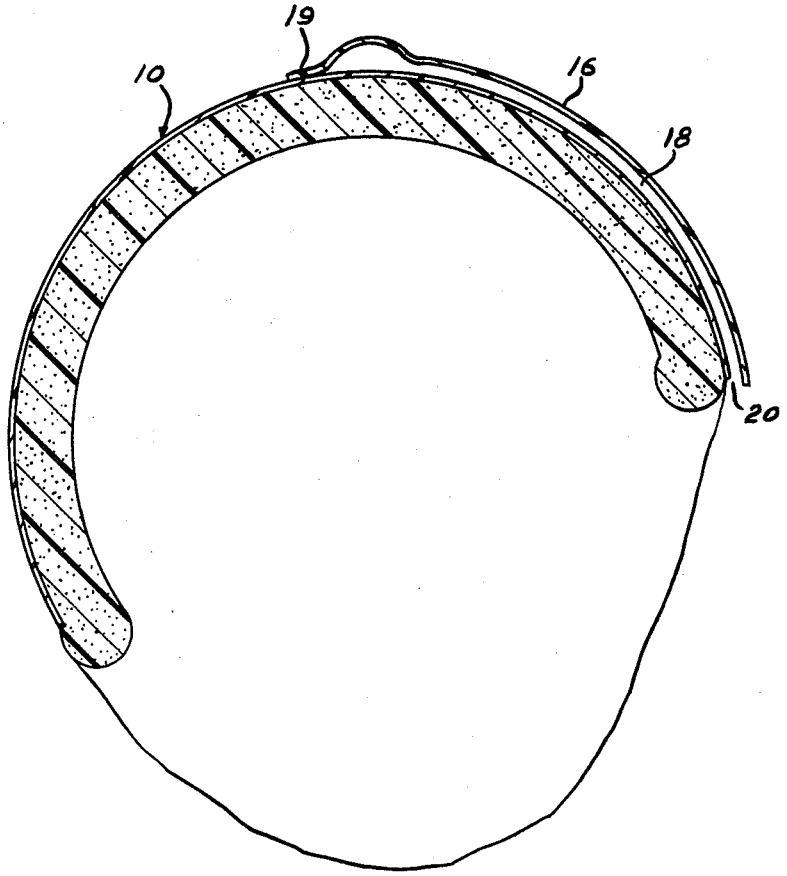
FIG. 4 is a sectional view of the device of FIG. 3 along the line 4—4.

Reference is now made to FIG. 1 of the drawing which shows a conventional flight helmet 10 which is normally worn with a visor 12 which may be raised or lowered in the visor assembly 14. A face mask 15 is also normally worn with the helmet 10.

To provide a flow of air between the user's face and the visor 12, a plenum chamber shell member 16 is secured to the helmet by means of threaded fasteners 17. The member 16 is spaced from the helmet 10 to provide a plenum chamber 18 between member 16 and the helmet 10. A close fit is provided between the helmet 10 and the edge portions 19 of member 16 so as to make the use of a seal unnecessary. However, a seal may be provided between helmet 10 and member 16 when needed.

An elongated exit nozzle 20 is formed at the forward end of plenum 17 by spacing the forward edge of member 16 about ¼ inch from the forward edge of helmet 10. The exit nozzle 20 is positioned to provide a flow of air between the visor 12 and the face of the user. Air is supplied to the plenum chamber 17 through inlet 22 from an air supply, not shown.

Spacers 24 are provided between the visor assembly 14 and the helmet 10 to adapt the visor to the helmet when the plenum chamber is attached. Flow control vanes, not shown, may be molded into the underside of member 16 between inlet 22 and exit nozzle 20 to provide a more uniform distribution of air across exit nozzle 20.

Either warm air or cool air, relative to the ambient temperature can be supplied through the plenum chamber 17. A temperature control, not shown, may be provided between the air supply and the plenum chamber 17. Over pressurization of the area between the user's face and the visor with uncontaminated air flow will preclude the entrance of noxious gases into the area between the user's face and the visor 12.

In the operation of the device, air which is supplied to plenum 17 flows out through nozzle 20 into the space between the user's face and the visor 12, when the visor is in its lowered position. This air flow can be used to cool or warm the face of the user. This air will slightly pressurize the space between the visor 12 and the user's face to cause a flow of air out from under the visor around the face mask. This will preclude the entrance of noxious gases into the space between the user's face and the visor 12.

There is thus provided an apparatus for use with a flight helmet which provides a flow of air in the space between the helmet visor and the face of the user for warming or cooling the face and which precludes the entrance of noxious gas into this space.

We claim:

1. In combination with a flight helmet having a visor assembly including a visor and a face mask attached thereto; an apparatus for providing an air flow between the visor and the face of the user of the helmet comprising: a shell member attached to said helmet and forming together with said helmet an air plenum chamber; said shell member having its forward portion adapted to fit between said visor assembly and said helmet; means, between said helmet and said visor assembly, for fitting said visor assembly to the helmet when the shell member is attached; the forward portion of said shell member being spaced from the forward portion of said helmet to form an air exit nozzle between the visor and face of the user of the helmet; said shell member including an air supply inlet for the plenum chamber; said means for fitting said visor assembly to the helmet, when the shell member is attached, includes a pair of blocks for spacing the visor assembly from the helmet.

* * * * *